US011299370B2

(12) United States Patent
Rajagopalan et al.

(10) Patent No.: US 11,299,370 B2
(45) Date of Patent: Apr. 12, 2022

(54) DATA TRANSMISSION VIA ELEVATOR SYSTEM TENSION MEMBER

(71) Applicant: Otis Elevator Company, Farmington, CT (US)

(72) Inventors: Ajit Rajagopalan, South Glastonbury, CT (US); Joseph V. Mantese, Ellington, CT (US); Brian L. McCabe, Orange, CT (US); Daniel A. Mosher, Glastonbury, CT (US); Brad Guilani, Woodstock Valley, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 958 days.

(21) Appl. No.: 16/023,775

(22) Filed: Jun. 29, 2018

(65) Prior Publication Data

US 2020/0002123 A1 Jan. 2, 2020

(51) Int. Cl.

| | |
|---|---|
| ***B66B 1/34*** | (2006.01) |
| ***B66B 5/02*** | (2006.01) |
| ***B66B 5/12*** | (2006.01) |

(52) U.S. Cl.

CPC ..... *B66B 1/3453* (2013.01); *B66B 5/022* (2013.01); *B66B 5/12* (2013.01)

(58) Field of Classification Search

CPC ..... B66B 1/3453; B66B 5/022; B66B 5/12
See application file for complete search history.

(56) References Cited

U.S. PATENT DOCUMENTS

| | | | | |
|---|---|---|---|---|
| 4,789,049 | A | 12/1988 | Watanabe et al. | |
| 5,834,942 | A | 11/1998 | De Angelis | |
| 6,923,065 | B2 * | 8/2005 | Smith | B66B 7/1215 324/535 |
| 7,494,004 | B2 | 2/2009 | Stolyar et al. | |
| 8,360,208 | B2 | 1/2013 | De Angelis | |
| 8,525,033 | B2 | 9/2013 | Grether | |
| 8,677,726 | B2 * | 3/2014 | Wesson | B66B 7/062 57/223 |
| 9,126,805 | B2 | 9/2015 | Pelto-Huikko et al. | |
| 9,385,447 | B2 * | 7/2016 | Dold | B66B 7/1223 |
| 9,422,134 | B2 | 8/2016 | Ikonen et al. | |
| 9,573,789 | B2 | 2/2017 | Appana | |

(Continued)

FOREIGN PATENT DOCUMENTS

| | | |
|---|---|---|
| CN | 101830382 A | 9/2010 |
| CN | 203179613 U | 9/2013 |

(Continued)

OTHER PUBLICATIONS

European Search Report Issued In EP Application No. 19183384.7, dated Nov. 15, 2019, 12 Pages.

(Continued)

*Primary Examiner* — Jeffrey Donels
(74) *Attorney, Agent, or Firm* — Cantor Colburn LLP

(57) ABSTRACT

A tension member for an elevator system includes one or more tension elements extending along a length of the tension member, and one or more a wave guide regions secured to at least one surface of the tension member or integral to the tension member and extending along the length of the tension member. The one or more wave guide regions are configured for transmission of a radio frequency (RF) data signal along the one or more wave guide regions.

15 Claims, 7 Drawing Sheets

(56) References Cited

U.S. PATENT DOCUMENTS

| | | | |
|---|---|---|---|
| 9,790,054 | B2 | 10/2017 | Alasentie |
| 9,828,215 | B2 | 11/2017 | Pelto-Huikko |
| 9,944,494 | B2 | 4/2018 | Alasentie et al. |
| 2004/0026177 | A1 | 2/2004 | Ayano et al. |
| 2006/0180402 | A1 | 8/2006 | Silberhorn et al. |
| 2011/0000746 | A1 | 1/2011 | Pelto-Huikko et al. |
| 2014/0305744 | A1 | 10/2014 | Kere et al. |
| 2014/0345978 | A1 | 11/2014 | Alasentie et al. |
| 2015/0191332 | A1 | 7/2015 | Kere |
| 2015/0307321 | A1 | 10/2015 | Breite et al. |
| 2017/0066629 | A1 | 3/2017 | Zhao et al. |
| 2017/0159236 | A1 | 6/2017 | Lehtinen et al. |
| 2018/0044137 | A1 | 2/2018 | Pelto-Huikko et al. |

FOREIGN PATENT DOCUMENTS

| | | | |
|---|---|---|---|
| CN | 203689985 | U | 7/2014 |
| CN | 203799702 | U | 8/2014 |
| CN | 104370173 | A | 2/2015 |
| CN | 104724577 | A | 6/2015 |
| CN | 204558082 | U | 8/2015 |
| CN | 205542054 | U | 8/2016 |
| EP | 1350886 | B1 | 5/2011 |
| EP | 2749521 | A2 | 7/2014 |
| EP | 2840051 | A1 | 2/2015 |
| JP | 2015048179 | A | 3/2015 |
| JP | 2017111895 | A | 6/2017 |
| SG | 2013093810 | A1 | 7/2014 |
| WO | 2011004071 | A2 | 1/2011 |
| WO | 2015162263 | A1 | 10/2015 |
| WO | 2017153250 | A1 | 9/2017 |

OTHER PUBLICATIONS

Chinese Office Action for Chinese Application No. 201910573381.5; dated Apr. 27, 2021; 12 pages.

* cited by examiner

DATA TRANSMISSION VIA ELEVATOR SYSTEM TENSION MEMBER

BACKGROUND

Exemplary embodiments pertain to the art of elevator systems. More particularly, the present disclosure relates to data transmission to and from an elevator car of an elevator system.

Elevator systems utilize a tension member operably connected to an elevator car and a counterweight in combination with, for example, a machine and traction sheave, to suspend and drive the elevator car along a hoistway. In some systems, the tension member is a belt having one or more tension elements retained in a jacket. The tension elements may be formed from, for example, steel wires or other materials, such as a carbon fiber composite. The tension elements support the load and the jacket holds the tension elements and transfers shear forces to the traction sheave.

The elevator car includes systems such as controls, communication, and entertainment that may require data to be transmitted to and from these systems at the elevator car. In typical elevator systems, such data communication to and from the elevator car is enabled by the use of a traveling cable, separate from the tension member. Length of the traveling cable, which in high-rise systems may approach one kilometer, adds significant cost to the elevator system and contributes to varying imbalance of the system, particularly systems that employ compensation members on the underside of the car and counterweight.

BRIEF DESCRIPTION

In one embodiment, a tension member for an elevator system includes one or more tension elements extending along a length of the tension member, and one or more a wave guide regions secured to at least one surface of the tension member or integral to the tension member and extending along the length of the tension member. The one or more wave guide regions are configured for transmission of a radio frequency (RF) data signal along the one or more wave guide regions.

Additionally or alternatively, in this or other embodiments the tension member is configured as a belt. The belt includes a jacket defining a traction side configured to interact with a drive sheave of the elevator system, and a back side opposite the traction side.

Additionally or alternatively, in this or other embodiments the one or more wave guide regions are secured at the back side of the belt.

Additionally or alternatively, in this or other embodiments the one or more wave guide regions are secured at an edge surface of the belt. The edge surface extends between the traction side and the back side.

Additionally or alternatively, in this or other embodiments the one or more wave guide regions are configured as a plurality of wave guide strips, each wave guide strip extending partially across a belt width of the belt.

Additionally or alternatively, in this or other embodiments an interlayer is located between the jacket and the one or more wave guide regions. The interlayer has a different refractive index than the one or more wave guide regions.

Additionally or alternatively, in this or other embodiments the tension member is configured as a synthetic fiber rope.

Additionally or alternatively, in this or other embodiments the one or more wave guide regions surround the one or more tension elements.

Additionally or alternatively, in this or other embodiments the one or more tension elements surrounds the one or more wave guide regions.

Additionally or alternatively, in this or other embodiments the tension member is configured as a synthetic fiber tape. The one or more wave guide regions are located at an outer surface of the synthetic fiber tape.

Additionally or alternatively, in this or other embodiments the one or more wave guide regions have a loss tangent of less than 0.001.

Additionally or alternatively, in this or other embodiments the one or more wave guide regions are formed from a low loss dielectric material including one or more of a polyolefin, a fluoropolymer, a polystyrene homo or co-polymers, micro-porous or nano-porous polymeric materials.

In another embodiment, an elevator system includes a hoistway, an elevator car movable along the hoistway, and a tension member operably connected to the elevator car to move the elevator car along the hoistway. The tension member includes one or more tension elements extending along a length of the tension member, and one or more wave guide regions secured to at least one surface of the tension member or integral to the tension member and extending along the length of the tension member. The one or more wave guide regions are configured for transmission of a radio frequency (RF) data signal along the one or more wave guide regions.

Additionally or alternatively, in this or other embodiments a non-contact transmitter is located in the hoistway and is configured to transmit the RF data signal to the one or more wave guide regions. A coupling is located at the elevator car to convey the RF data signal from the one or more wave guide regions to one or more systems of the elevator car.

Additionally or alternatively, in this or other embodiments the one or more systems are one or more of a car control system, a communication system, or an entertainment system.

Additionally or alternatively, in this or other embodiments the RF data signal includes one or more of an audio signal, a video signal, a control signal, a prognostic health management signal or a condition based monitoring signal.

Additionally or alternatively, in this or other embodiments the tension member is configured as a belt including a jacket having a traction side configured to interact with a drive sheave of the elevator system and a back side opposite the traction side. The one or more wave guide regions are secured at one of the back side or an edge surface of the belt. The edge surface extends between the traction side and the back side.

Additionally or alternatively, in this or other embodiments the tension member is configured as a synthetic fiber rope and the one or more wave guide regions surround or are surrounded by the one or more tension elements.

Additionally or alternatively, in this or other embodiments the tension member is configured as a synthetic fiber tape. The one or more wave guide regions are located at an outer surface of the synthetic fiber tape.

Additionally or alternatively, in this or other embodiments the data signal has a frequency of 1 MHz or greater.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
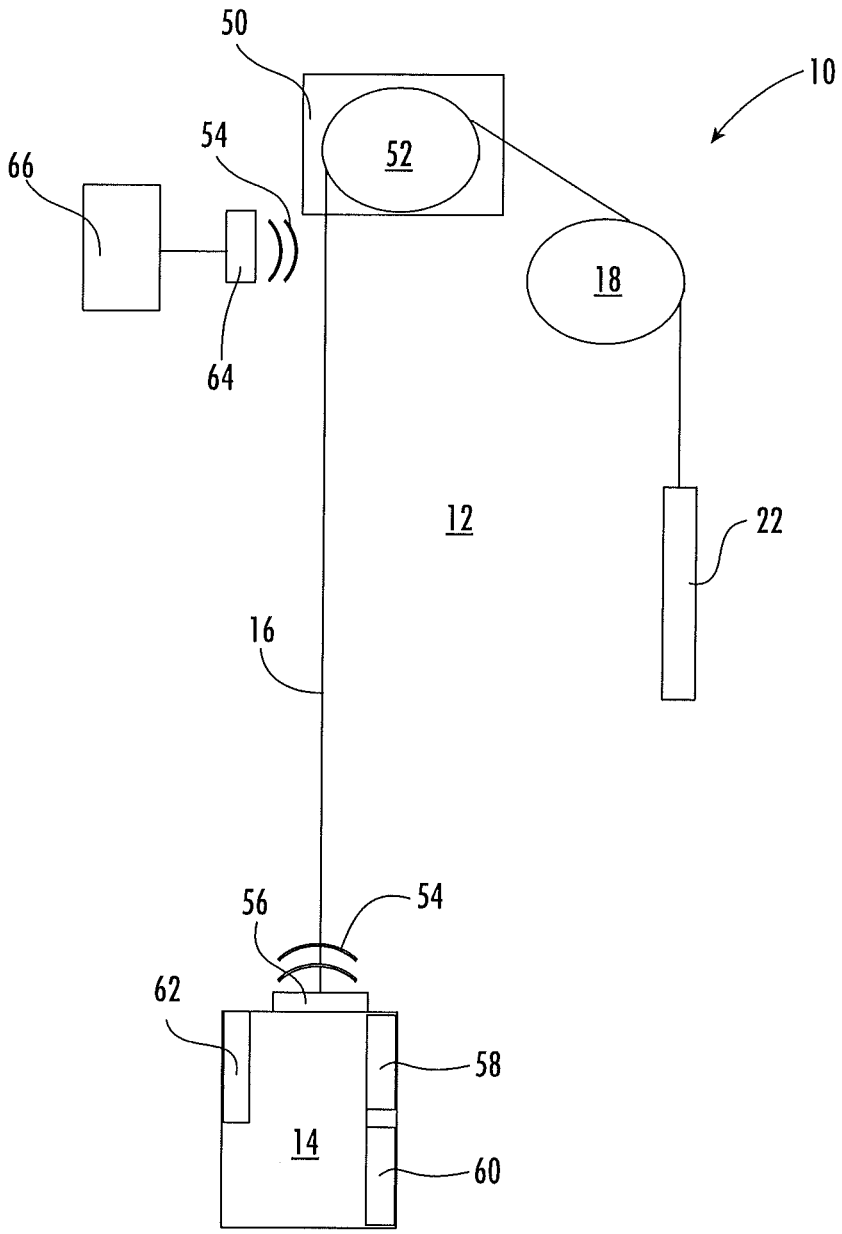
FIG. 1 is a schematic illustration of an elevator system.

Shown in FIG. 1 is a schematic view of an exemplary traction elevator system 10. Features of the elevator system 10 that are not required for an understanding of the present invention (such as the guide rails, safeties, etc.) are not discussed herein. The elevator system 10 includes an elevator car 14 operatively suspended and/or propelled in a hoistway 12 with one or more tension members, for example belts 16. While in the following description, belts 16 are the tension members utilized in the elevator system, one skilled in the art will readily appreciate that the present disclosure may be utilized with other tension members, such as ropes or braided tapes. The one or more belts 16 interact with sheaves 18 and 52 to be routed around various components of the elevator system 10. Sheave 18 is configured as a diverter, deflector or idler sheave and sheave 52 is configured as a traction sheave, driven by a machine 50. Movement of the traction sheave 52 by the machine 50 drives, moves and/or propels (through traction) the one or more belts 16 that are routed around the traction sheave 52. Diverter, deflector or idler sheaves 18 are not driven by a machine 50, but help guide the one or more belts 16 around the various components of the elevator system 10. The one or more belts 16 could also be connected to a counterweight 22, which is used to help balance the elevator system 10 and reduce the difference in belt tension on both sides of the traction sheave during operation. The sheaves 18 and 52 each have a diameter, which may be the same or different from each other.

In some embodiments, the elevator system 10 could use two or more belts 16 for suspending and/or driving the elevator car 14. In addition, the elevator system 10 could have various configurations such that either both sides of the one or more belts 16 engage the sheaves 18, 52 or only one side of the one or more belts 16 engages the sheaves 18, 52. The embodiment of FIG. 1 shows a 1:1 roping arrangement in which the one or more belts 16 terminate at the car 14 and counterweight 22, while other embodiments may utilize other roping arrangements.

The belts 16 are constructed to meet belt life requirements and have smooth operation, while being sufficiently strong to be capable of meeting strength requirements for suspending and/or driving the elevator car 14 and counterweight 22.

Figure 2:
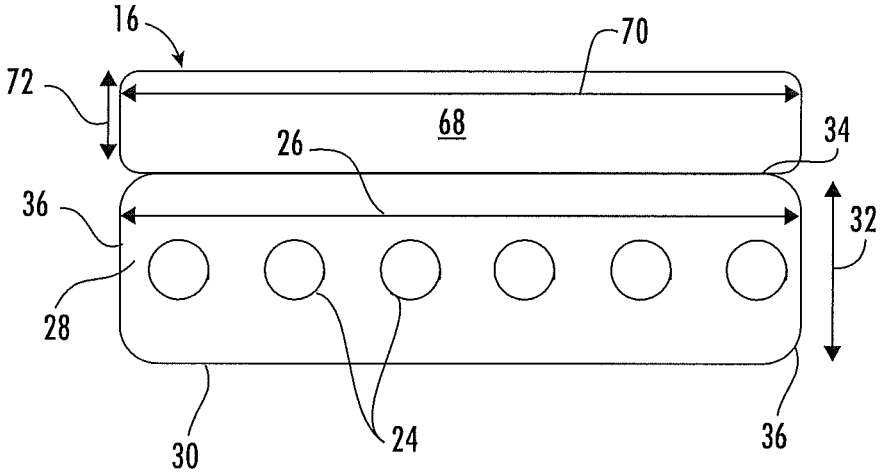
FIG. 2 is a cross-sectional view of an embodiment of an elevator system belt.

FIG. 2 provides a cross-sectional schematic of an exemplary belt 16 construction or design. The belt 16 includes a plurality of tension elements 24 extending longitudinally along the belt 16 and arranged across a belt width 26. The tension elements 24 are at least partially enclosed in a jacket 28 to restrain movement of the tension elements 24 in the belt 16 with respect to each other and to protect the tension elements 24. The jacket 28 defines a traction side 30 configured to interact with a corresponding surface of the traction sheave 52. A primary function of the jacket 28 is to provide a sufficient coefficient of friction between the belt 16 and the traction sheave 52 to produce a desired amount of traction there between. The jacket 28 should also transmit the traction loads to the tension elements 24. In addition, the jacket 28 should be wear resistant, fatigue resistant and protect the tension elements 24 from impact damage, exposure to environmental factors, such as chemicals, for example.

Exemplary materials for the jacket 28 include the elastomers of thermoplastic and thermosetting polyurethanes, thermoplastic polyester elastomers, ethylene propylene diene elastomer, chloroprene, chlorosulfonyl polyethylene, ethylene vinyl acetate, polyamide, polypropylene, butyl rubber, acrylonitrile butadiene rubber, styrene butadiene rubber, acrylic elastomer, fluoroelastomer, silicone elastomer, polyolefin elastomer, styrene block and diene elastomer, natural rubber, or combinations thereof. Other materials may be used to form the jacket material 28 if they are adequate to meet the required functions of the belt 16.

The belt 16 has a belt width 26 and a belt thickness 32, with an aspect ratio of belt width 26 to belt thickness 32 greater than one. The belt 16 further includes a back side 34 opposite the traction side 30 and belt edges 36 extending between the traction side 30 and the back side 34. While six tension elements 24 are illustrated in the embodiment of FIG. 2, other embodiments may include other numbers of tension elements 24, for example, 4, 10 or 12 tension elements 24. Further, while the tension elements 24 of the embodiment of FIG. 2 are substantially identical, in other embodiments, the tension elements 24 may differ from one another. While a belt 16 with a rectangular cross-section is illustrated in FIG. 2, it is to be appreciated that belts 16 having other cross-sectional shapes are contemplated within the scope of the present disclosure.

Figure 3A:
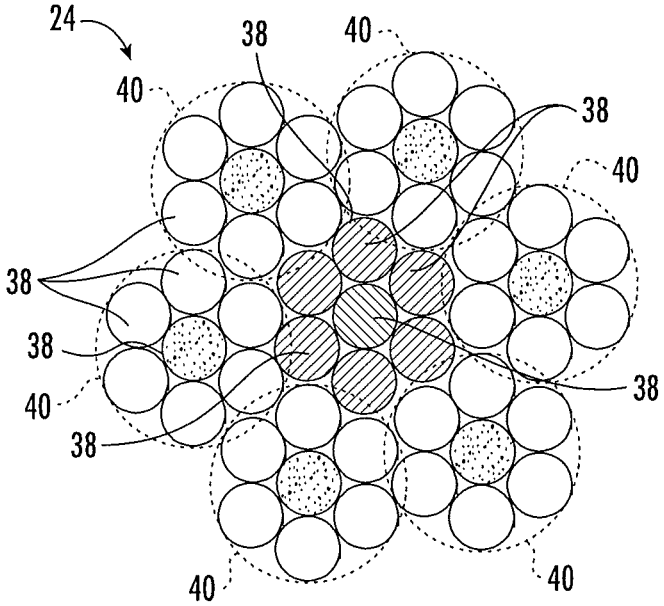
FIG. 3A is a cross-sectional view of an embodiment of a tension element for an elevator tension member.
Figure 3B:
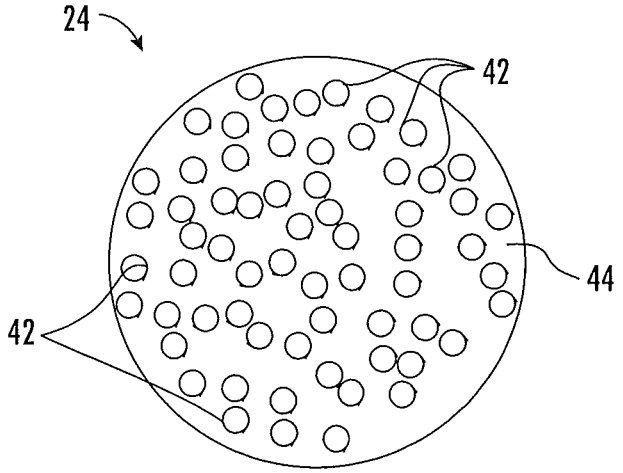
FIG. 3B is a cross-sectional view of another embodiment of a tension element for an elevator tension member.

Referring now to FIG. 3A, the tension element 24 may be a plurality of wires 38, for example, steel wires 38, which in some embodiments are formed into one or more strands 40. In other embodiments, such as shown in FIG. 3B, the tension element 24 may include a plurality of fibers 42, such as carbon fiber, glass fiber aramid fiber, or their combination, disposed in a matrix material 44. Materials such as polyurethane, vinylester, or epoxy may be utilized as the matrix material, as well as other thermoset materials and, for example, thermoset polyurethane materials. While a circular cross-sectional tension element geometry is illustrated in the embodiment of FIG. 3B, other embodiments may include different tension element cross-sectional geometries, such as rectangular or ellipsoidal. While the cross-sectional geometries of the tension elements 24 in FIG. 2 are shown as identical, in other embodiment the tension elements' cross-sectional geometries may differ from one another. Further, while the present disclosure is described in the context of a belt 16, one skilled in the art will readily appreciate that the disclosure may be readily applied to elevator systems 10 utilizing other types of tension members, for example a coated rope. Further, the present disclosure may be utilized with not only a tension member, but also a compensation member.

Referring again to FIG. 1, the elevator system 10 is configured to transmit data signals, schematically shown at 54, along the belt 16. In one embodiment, the data signals are radio frequency (RF) signals, and may include signals carrying audio and/or video content, and/or control signals utilized to control operation of the elevator system 10. In some embodiments, the frequency of the data signals is in the range of 1 MHz and above. Further, the data signals may include diagnostic data regarding the condition of the elevator system 10 for prognostics health management (PHM) and/or condition based monitoring (CBM). In the embodiment of FIG. 1, a coupling 56 is located at the elevator car 14 to transfer the data signals between the belt 16 and systems of the elevator car 14, such as a car control system 58, entertainment system 60 or communication system 62, for example. Further, a transmitter/receiver 64 is connected to an elevator system controller 66 to transfer the data signals 54 between the elevator system controller 66 and the belt 16. The transmitter/receiver 64 transfers data wirelessly via non-contact coupling with the belt 16. While in the embodiment of FIG. 1, the coupling 56 is connected to the belt 16 and the data signals 54 are transferred there via a wired, contact connection. In other embodiments, the connection may also be non-contact coupling.

Referring now to FIG. 2, the transmission of data signals 54 along the elevator belt 16 is enabled by a wave guide layer 68 as an integral part of or as applied to the elevator belt 16 at, for example, the back side 34 of the belt 16. The wave guide layer 68 minimizes lateral radiation of and losses in the data signals 54 as they travel along the length of the belt 16. In some embodiments, the material of the wave guide layer 68 has a loss tangent of less than 0.001. To achieve this, the wave guide layer 68 is formed from, for example, low loss dielectric materials including but not limited to polyolefins, fluoropolymers, and polystyrene homo and co-polymers, as well as micro-porous or nano-porous polymeric materials. In some embodiments, the wave guide layer 68 has a wave guide width 70 in the belt width 26 direction greater than a wave guide thickness 72 in the belt thickness 32 direction.

Figure 4:
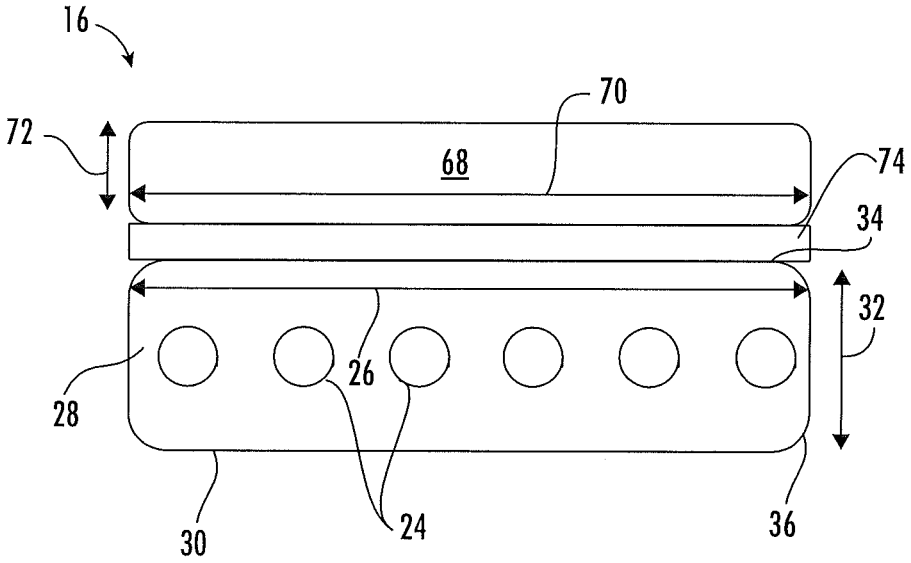
FIG. 4 is a cross-sectional view of another embodiment of an elevator system belt.

Referring now to FIG. 4, in some embodiments an interlayer 74 is positioned between the wave guide layer 68 and the back side 34 of the belt 16. The interlayer 74 is formed from a material having a different refractive index when compared to the wave guide layer 68. The interlayer 74 may be formed from, for example, fluoropolymers including but not limited to poly(tetrafluoroethylene), perfluoroacrylate, and other fluorinated polymers that have a lower refractive index than the waveguide layer material 68. The interlayer 74 may also incorporate a metallized polymer or metal-containing polymer film to aid in the reflection of travelling waves.

Figure 5:
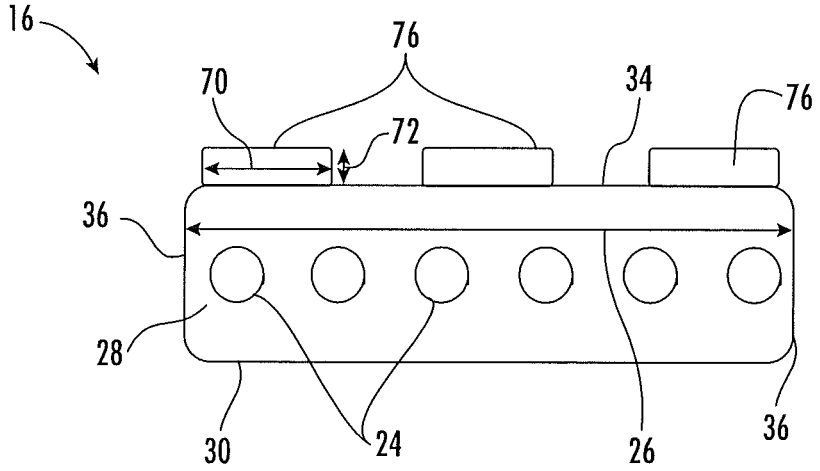
FIG. 5 is a cross-sectional view of yet another embodiment of an elevator system belt.

While in the embodiments of FIGS. 2 and 4, the wave guide layer 68 extends along an entire belt width 26. Alternatively, in other embodiments as shown in FIG. 5, the wave guide layer is one or more wave guide strips 76 located at the back side 34 of the belt 16. In some embodiments, each of the wave guide strips 76 have a wave guide width 70 in the belt width 26 direction greater than a wave guide thickness 72 in the belt thickness 32 direction.

Figure 6:
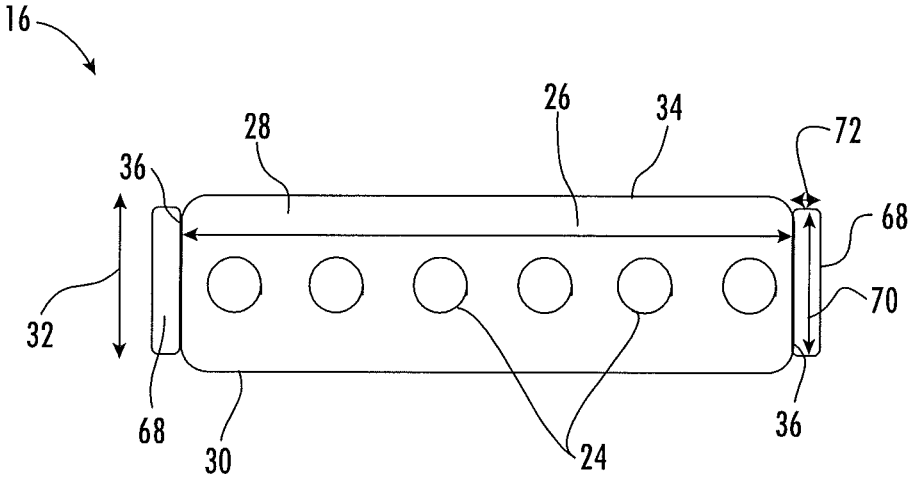
FIG. 6 is a cross-sectional view of still another embodiment of an elevator system belt.

While in some embodiments, the wave guide layer 68 or wave guide strips 76 are located on the back side 34 of the belt 16, in other embodiments they may be at other locations on the belt 16. For example, in the embodiment of FIG. 6, the wave guide layers 68 are located at one or more of the belt edges 36. This allows for elevator system 10 construction where both the traction side 30 and the back side 34 are more readily routed over deflector sheaves 18.

Figure 7A:
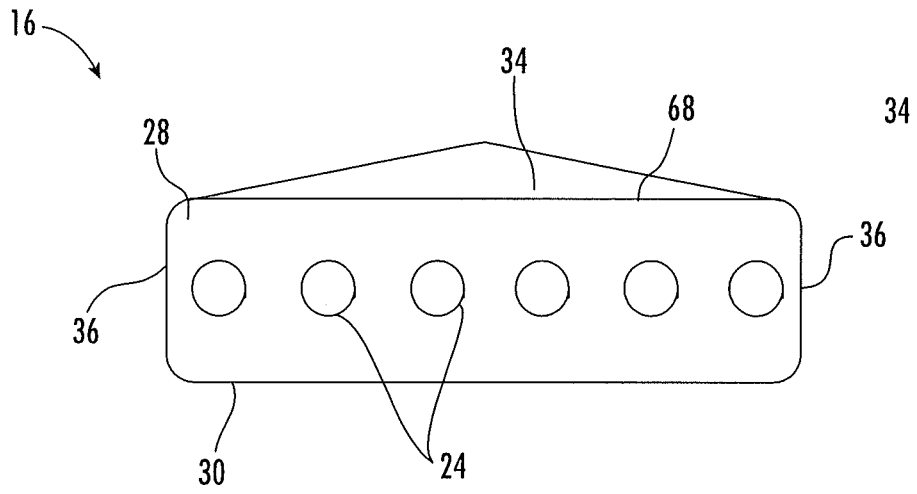
FIGS. 7A and 7B illustrate alternate exemplary configurations of wave guide layers.
Figure 7B:
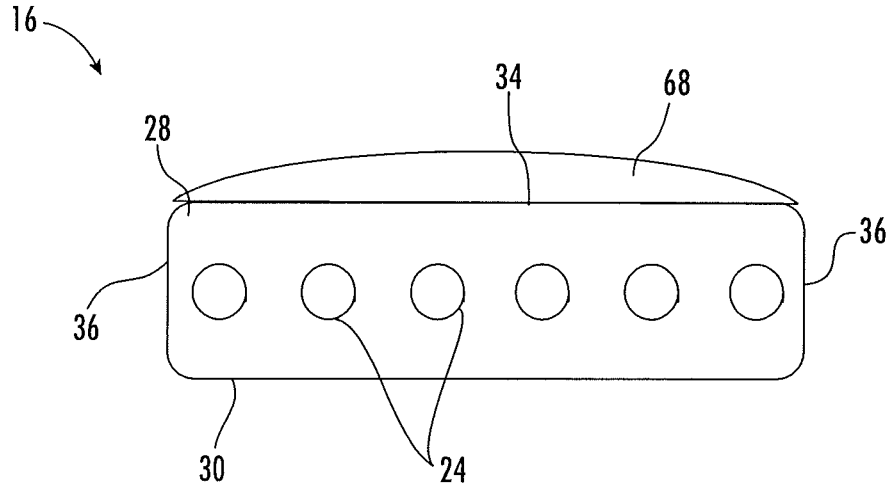

Referring now to FIGS. 7A and 7B, wave guide layers 68 having shapes other than rectangular may be utilized. For example, as shown in FIG. 7A, the wave guide layer 68 may have a triangular cross-section, while in FIG. 7B the wave guide layer 68 may have a partially curvilinear cross-section. It is to be appreciated that these cross-sectional shapes are merely exemplary, and other cross-sectional shapes of the wave guide layer 68 and of wave guide strips 76 are contemplated within the scope of the present disclosure.

Figure 8:
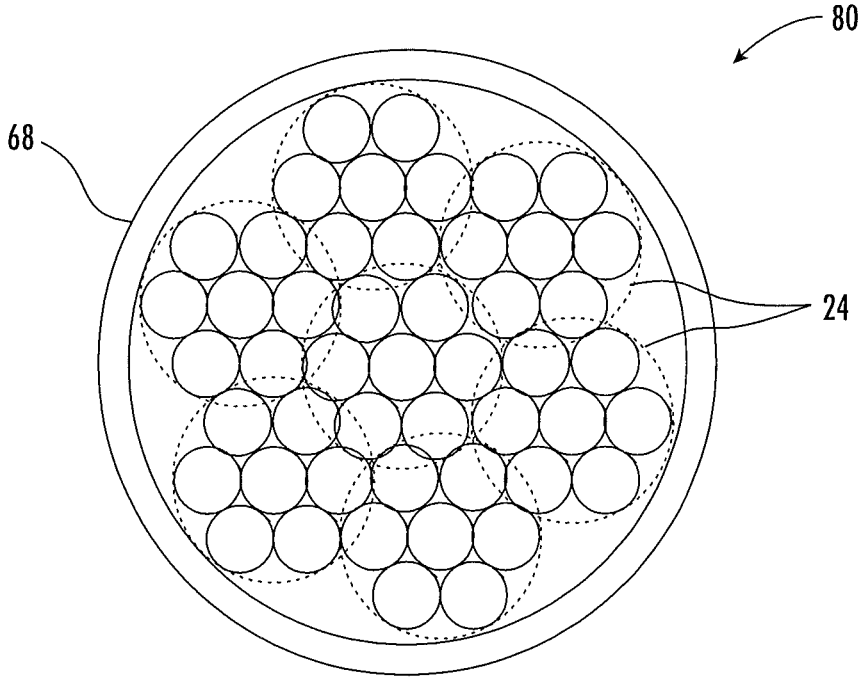
FIG. 8 illustrates an embodiment of a synthetic fiber rope having a wave guide layer.
Figure 9:
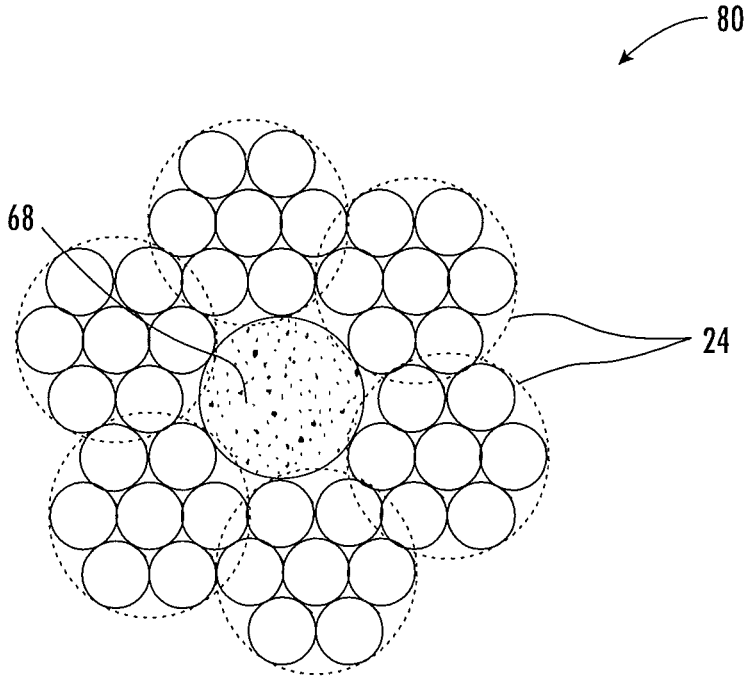
FIG. 9 illustrates another embodiment of a synthetic fiber rope having a wave guide layer.
Figure 10:
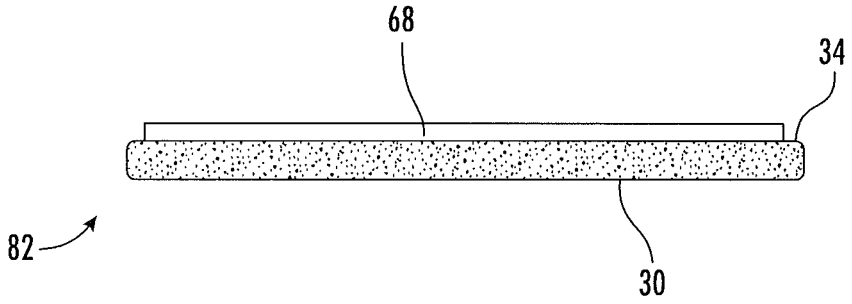
FIG. 10 illustrates an embodiment of a synthetic fiber tape having a wave guide layer.

In another embodiment, as shown in FIG. 8, the tension member is a synthetic fiber rope 80 having a plurality of tension elements 24 formed from, for example, a plurality of carbon fibers, glass fibers, aramid fibers and/or other fibers. In the embodiment of FIG. 8, the wave guide layer 68 surrounds the plurality of tension elements 24, or alternatively one or more of the tension elements 24. Alternatively, as shown in the embodiment of FIG. 9, the wave guide layer 68 is disposed in an interior of the synthetic fiber rope 80, such as a circular core of the synthetic fiber rope 80. In yet another embodiment, as shown in FIG. 10, the tension member is a synthetic fiber tape 82 with a plurality of woven or braided fibers. The wave guide layer 68 is disposed at, for example, a back side 34 of the synthetic fiber tape 82.

Use of the wave guide layers 68 of the belt 16 for data transmission along the belt 16 eliminates the need for a traveling cable. Using the wave guide layer around the tension elements 24 for transmission of the data signals 54 can lead to wave guiding structure with lower losses than using the tension elements 24 themselves for data signal transmission.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A tension member for an elevator system, comprising:
one or more tension elements extending along a length of the tension member; and
one or more a wave guide regions secured to at least one surface of the tension member or integral to the tension member and extending along the length of the tension member, the one or more wave guide regions configured for transmission of a radio frequency (RF) data signal along the one or more wave guide regions;
wherein the tension member is configured as a belt, the belt including a jacket defining:
a traction side configured to interact with a drive sheave of the elevator system; and
a back side opposite the traction side; and
wherein the one or more wave guide regions are secured at an edge surface of the belt, the edge surface extending between the traction side and the back side.

2. The tension member of claim 1, wherein the one or more wave guide regions are secured at the back side of the belt.

3. The tension member of claim 1, wherein the one or more wave guide regions are configured as a plurality of wave guide strips, each wave guide strip extending partially across a belt width of the belt.

4. The tension member of claim 1, further comprising an interlayer disposed between the jacket and the one or more wave guide regions, the interlayer having a different refractive index than the one or more wave guide regions.

5. A tension member for an elevator system, comprising:
one or more tension elements extending along a length of the tension member; and
one or more a wave guide regions secured to at least one surface of the tension member or integral to the tension member and extending along the length of the tension member, the one or more wave guide regions configured for transmission of a radio frequency (RF) data signal along the one or more wave guide regions;
wherein the tension member is configured as a synthetic fiber rope;
wherein the one or more wave guide regions surround the one or more tension elements.

6. The tension member of claim 1, wherein the tension member is configured as a synthetic fiber tape, the one or more wave guide regions disposed at an outer surface of the synthetic fiber tape.

7. The tension member of claim 1, wherein the one or more wave guide regions have a loss tangent of less than 0.001.

8. The tension member of claim 1, wherein the one or more wave guide regions are formed from a low loss dielectric material including one or more of a polyolefin, a fluoropolymer, a polystyrene homo or co-polymers, microporous or nano-porous polymeric materials.

9. An elevator system, comprising:
a hoistway;
an elevator car movable along the hoistway;
a tension member operably connected to the elevator car to move the elevator car along the hoistway, the tension member including:
one or more tension elements extending along a length of the tension member; and
one or more wave guide regions secured to at least one surface of the tension member or integral to the tension member and extending along the length of the tension member, the one or more wave guide regions configured for transmission of a radio frequency (RF) data signal along the one or more wave guide regions;
wherein the tension member is configured as a belt, including a jacket including:
a traction side configured to interact with a drive sheave of the elevator system; and
a back side opposite the traction side;
wherein the one or more wave guide regions are secured at one of the back side or an edge surface of the belt, the edge surface extending between the traction side and the back side.

10. The elevator system of claim 9, further comprising:
a non-contact transmitter disposed in the hoistway configured to transmit the RF data signal to the one or more wave guide regions; and
a coupling disposed at the elevator car to convey the RF data signal from the one or more wave guide regions to one or more systems of the elevator car.

11. The elevator system of claim 10, wherein the one or more systems are one or more of a car control system, a communication system, or an entertainment system.

12. The elevator system of claim 10 wherein the RF data signal includes one or more of an audio signal, a video signal, a control signal, a prognostic health management signal or a condition based monitoring signal.

13. The elevator system of claim 9, wherein the tension member is configured as a synthetic fiber rope and the one or more wave guide regions surround or are surrounded by the one or more tension elements.

14. The elevator system of claim 9, wherein the tension member is configured as a synthetic fiber tape, the one or more wave guide regions disposed at an outer surface of the synthetic fiber tape.

15. The elevator system of claim 9, wherein the data signal has a frequency of 1 Mhz or greater.

* * * * *